US006790033B2

(12) United States Patent
Grady et al.

(10) Patent No.: US 6,790,033 B2
(45) Date of Patent: Sep. 14, 2004

(54) OUTDOOR FIREPLACE WITH CASCADING WATERFALL FIRE SCREEN

(75) Inventors: Jeffrey T. Grady, Naperville, IL (US); David Henke, Hawthorn Woods, IL (US); Kent Bach, Villa Park, IL (US)

(73) Assignee: Fleming Sales Company, Inc., Addison, IL (US)

( * ) Notice: Subject to any disclaimer, the term of this patent is extended or adjusted under 35 U.S.C. 154(b) by 84 days.

(21) Appl. No.: 10/236,387

(22) Filed: Sep. 6, 2002

(65) Prior Publication Data

US 2003/0041855 A1 Mar. 6, 2003

Related U.S. Application Data

(60) Provisional application No. 60/317,645, filed on Sep. 6, 2001.

(51) Int. Cl.[7] ..... F24B 1/18; B05B 17/08

(52) U.S. Cl. ..... 431/253; 126/512; 126/500; 126/519; 239/18; 239/20; 239/23

(58) Field of Search ..... 126/500, 512, 126/519, 544, 355.1, 359.1, 360.2, 304 A; 222/113; 362/96; 239/18, 20, 23; 431/253

(56) References Cited

U.S. PATENT DOCUMENTS

| | | | | | |
|---|---|---|---|---|---|
| 1,049,325 | A | * | 12/1912 | Huber | 126/359.1 |
| 2,005,602 | A | * | 6/1935 | Frederick | 239/18 |
| 3,038,064 | A | * | 6/1962 | Gieb | 431/125 |
| 3,104,814 | A | * | 9/1963 | Boaerder | 239/18 |
| 3,442,232 | A | * | 5/1969 | White | 110/215 |
| 3,565,337 | A | * | 2/1971 | Ditto | 239/18 |
| 3,602,299 | A | * | 8/1971 | Mozic | 166/351 |
| 3,777,735 | A | * | 12/1973 | Miller | 126/519 |
| 3,830,217 | A | * | 8/1974 | Maness et al. | 126/513 |
| 4,858,826 | A | | 8/1989 | Robinson et al. | |
| 5,092,312 | A | | 3/1992 | Zolow | |
| 5,961,042 | A | | 10/1999 | Doyle | |
| 6,443,364 | B1 | * | 9/2002 | Lin | 239/17 |

FOREIGN PATENT DOCUMENTS

| | | | |
|---|---|---|---|
| EP | 0093973 | * | 4/1983 |
| JP | 02-98002 | * | 4/1990 |
| JP | 02-283383 | * | 11/1990 |
| JP | 03-37904 | * | 2/1991 |
| JP | 08-252380 | * | 10/1996 |
| WO | WO 91/18240 | * | 11/1991 |

OTHER PUBLICATIONS

US20010036609A1, Nov. 2001.*

* cited by examiner

*Primary Examiner*—Carl D. Price
(74) *Attorney, Agent, or Firm*—Cook, Alex, McFarron, Manzo, Cummings & Mehler, Ltd.

(57) ABSTRACT

A fireplace fountain having a base, a basin adapted to hold a liquid supported by the base, and a hood supported by the base over the basin. A fire pan is supported by the base over the basin and under the hood, with a burner being supported above the fire pan and adapted to be connected to a fuel source. A perforated tubing is supported in the hood, with a pump and supply tube connected thereto. The pump and supply tube are in fluid communication with the basin so that liquid held in the basin may be circulated by a pump to the perforated tubing. Liquid exits the perforated tubing and falls into the basin, but not into the fire pan so that the liquid does not extinguish any flame generated by the burner.

4 Claims, 2 Drawing Sheets

OUTDOOR FIREPLACE WITH CASCADING WATERFALL FIRE SCREEN

CROSS-REFERENCE TO RELATED APPLICATION

This application claims the benefit of the filing date of U.S. Provisional Application Ser. No. 60/317,645, filed Sep. 6, 2001.

BACKGROUND OF THE INVENTION

The present invention relates to a self-contained fireplace that, in use, creates a visually unique impression and, more particularly, to a freestanding fireplace unit with an integral fountain that creates a ring of cascading water that encircles the fire.

Freestanding fireplace units for outdoor and indoor use have become increasingly popular. Such units are used primarily for the atmosphere they create, rather than for utilitarian reasons. Because these fireplaces are self-contained, they provide for enhanced safety over open campfires and permit a fire to be enjoyed under conditions that would otherwise dictate against making a fire. The present invention relates to an aesthetically pleasing enhancement to a gas-burning freestanding fireplace unit.

DETAILED DESCRIPTION

Figure 1:
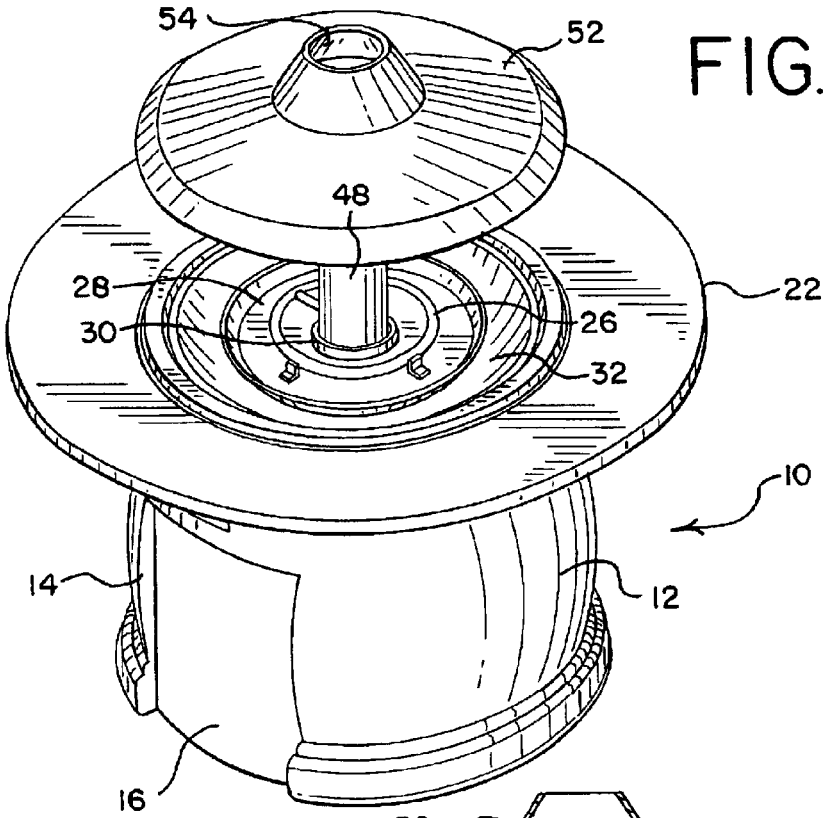
FIG. 1 is a perspective view of a freestanding fireplace unit according to the present invention.
Figure 2:
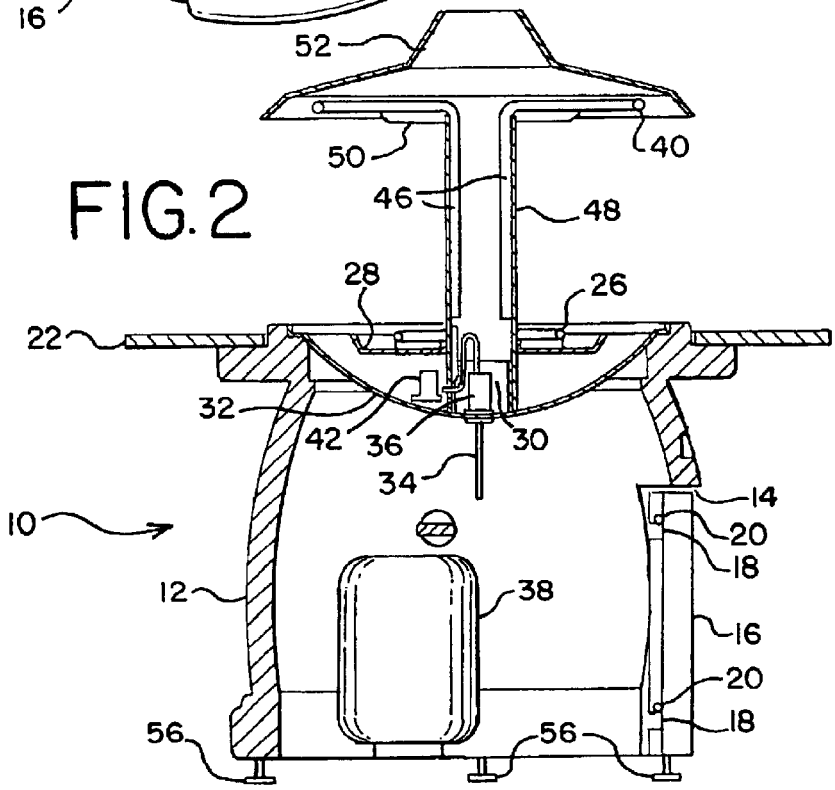
FIG. 2 is a vertical cross sectional view of the freestanding fireplace unit of FIG. 1.
Figure 3:
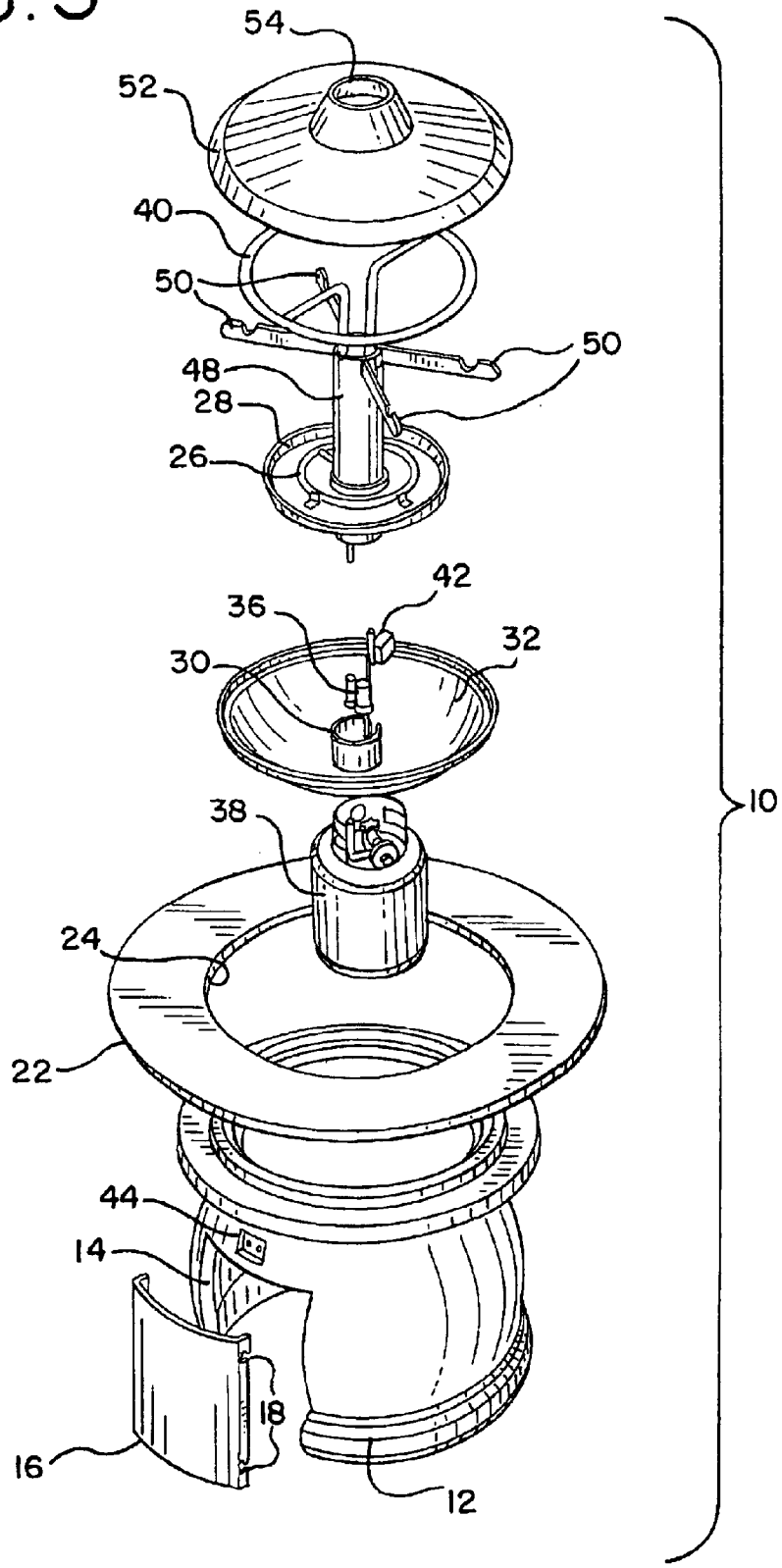
FIG. 3 is an exploded perspective view of the freestanding fireplace unit of FIG. 1.

With reference to the drawings, there is seen a freestanding fireplace, generally indicated 10, according to the present invention. The fireplace 10 includes a hollow base 12, with a side opening 14. The side opening 14 is adapted to receive a removable cover or door 16, thus providing access to the interior of the base. As illustrated, the cover 16 is made of sheet steel and has slots 18 on its opposite side edges that slidably fit over pins or pegs 20 in the opening 14 to permit the door 16 to be secured to the base. Alternatively, the door 16 could be secured to the base 12 by, e.g., hinges.

The upper end of the base 12 supports a circular table top 22 having a central opening 24. As shown, the table top 22 is formed in a single piece. However, the table top may be formed of multiple pieces, such as in 2, 3 or 4 sections, which may be joined together upon assembly of the fireplace.

In keeping with one aspect of the invention, the fire for the fireplace 10 is provided by means of a self-contained gas burner. As illustrated, a perforated gas ring or burner 26 is supported on a fire pan 28 in the opening 24 of the table top 22 so that the gas ring 26 is approximately at table-top level. The fire pan 28 has an diameter that is smaller than the diameter of the opening 24. Consequently, the fire pan is supported on a vertical stack or collar 48 that nests on a vertical collar 30. The collar 30 is secured to a basin 32; the basin 32 having a diameter sized to fit in and be supported by the opening 24 in the table top 22.

A feed tube 34 extends downwardly from the gas ring 26 through a bushing 36 in the bottom of the basin 32. The feed tube 34 is adapted to be connected to a source of fuel, such as a tank 38 containing LP gas or a similar fuel that is located within the hollow base 12. As is readily appreciated, the removable door 16 provides access to the tank 38 for, e.g., controlling the fuel flow and changing tanks. However, a separate control for controlling fuel flow may be provided on the exterior of the base. As illustrated, an on/off switch 44 for the gas supply and an igniter is provided on the base 12 above the opening 14 for the door 16.

In keeping with another aspect of the invention, a cascading water curtain is provided that encircles the fire provided by the gas ring 26. To this end, a perforated water ring 40 is supported above the gas ring 26. The water ring 40 has diameter greater than that of the gas ring 26 and the fire pan 28, but less than that of the basin 32. Consequently, water falling or cascading from the water ring 40 does not land or splash on the gas ring 26, which might extinguish the fire. Instead, the water substantially entirely falls into the basin 32, from where it is re-circulated to the water ring 40 by means of a water pump 42. The water pump 42 may be battery powered (as shown) or receive power from an external source.

As illustrated, a down tubing 46 connects the water ring 40 to the pump 42, with the down tubing 46 being enshrouded by the vertical stack or collar 48. The lower end of the collar 48 extends through the fire pan 28 and nests over the vertical collar 30 that is secured to the basin 32. The vertical stack includes four diagonally-oriented supports 50 at its upper end that serve to support the water ring 40 and a steel hood or cover 52. The steel hood 52 serves to both obscure the water ring 40 from vision and as a fire screen to contain the flame and heat created by the gas ring 26. The hood 52 also includes a central hole 54 through which smoke or other combustion byproducts may be exhausted.

The base 12 also includes a plurality of levelers 56 to level the base to insure that the water falls into the basin. The levelers 56 also create a space between the bottom of the base 12 and the surface on which it is supported, thus preventing any accumulation of gas in the interior of the base 12.

Thus, an outdoor fireplace with a cascading waterfall fire screen has been provided. While the invention has been described in terms of a preferred embodiment, there is no intent to limit it to the same. Instead, the invention is defined by the following claims.

What is claimed:

1. A fireplace fountain comprising:

a base;

a basin adapted to hold a liquid supported by the base;

a hood supported over the basin;

a fire pan supported over the basin and under the hood;

a burner supported above and adjacent to the fire pan and adapted to be connected to a fuel source;

a perforated tubing supported in the hood, and a pump and supply tube connected to the perforated tubing and in fluid communication with the basin so that liquid held in the basin may be circulated by the pump to the perforated tubing, where the liquid exits the perforated tubing and falls into the basin.

2. The fireplace fountain of claim 1 wherein the basin defines a first perimeter, the fire pan defines a second perimeter, and the perforated tubing defines a third perimeter, the third perimeter being less than the first perimeter and greater than the second perimeter so that liquid exiting the perforated tubing falls substantially completely into the basin, but not into the fire _pan.

3. The fireplace fountain of claim 1 wherein the base has a bottom that includes a plurality of adjustable levelers that create a space between the bottom of the base and a surface on which it is supported.

4. A fireplace fountain comprising:

a base;

a basin adapted to hold a liquid supported by the base;

a hood supported over the basin;

a fire pan supported over the basin and under the hood;

a burner supported above the fire pan and adapted to be connected to a fuel source;

a perforated tubing supported in the hood, and a pump and supply tube connected to the perforated tubing and in fluid communication with the basin so that liquid held in the basin may be circulated by the pump to the perforated tubing, wherein the basin defines a first perimeter, the fire pan defines a second perimeter, and the perforated tubing defines a third perimeter, the third perimeter being less than the first perimeter and greater than the second perimeter so that liquid exiting the perforated tubing falls substantially completely into the basin, but not into the fire pan.

* * * * *